US012595525B2

(12) United States Patent
Morishige et al.

(10) Patent No.: US 12,595,525 B2
(45) Date of Patent: Apr. 7, 2026

(54) METHOD FOR PRODUCING ELECTRICAL STEEL SHEET

(71) Applicant: NIPPON STEEL CORPORATION, Tokyo (JP)

(72) Inventors: Nobusato Morishige, Tokyo (JP); Kazumi Mizukami, Tokyo (JP); Daisuke Itabashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 656 days.

(21) Appl. No.: 18/012,830

(22) PCT Filed: Jun. 23, 2021

(86) PCT No.: PCT/JP2021/023779

§ 371 (c)(1),
(2) Date: Dec. 23, 2022

(87) PCT Pub. No.: WO2021/261515

PCT Pub. Date: Dec. 30, 2021

(65) Prior Publication Data

US 2023/0257841 A1 Aug. 17, 2023

(30) Foreign Application Priority Data

Jun. 24, 2020 (JP) ..... 2020-108343

(51) Int. Cl.

| | |
|---|---|
| ***C22C 38/02*** | (2006.01) |
| ***C21D 8/1216*** | (2026.01) |
| ***C21D 8/1244*** | (2026.01) |
| ***C21D 8/1277*** | (2026.01) |
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/08*** | (2006.01) |
| ***C22C 38/60*** | (2006.01) |

(52) U.S. Cl.
CPC ..... *C21D 8/1283* (2013.01); *C21D 8/1222* (2013.01); *C21D 8/1272* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/60* (2013.01)

(58) Field of Classification Search
CPC ..... C22C 38/02; C22C 38/04
See application file for complete search history.

(56) References Cited

U.S. PATENT DOCUMENTS

| | | | | |
|---|---|---|---|---|
| 3,932,234 | A | 1/1976 | Imanaka et al. | |
| 5,803,988 | A | 9/1998 | Bae et al. | |
| 2006/0076086 | A1 | 4/2006 | Terashima et al. | |
| 2023/0243010 | A1* | 8/2023 | Kataoka | C22C 38/16 148/111 |
| 2023/0243013 | A1* | 8/2023 | Morishige | C21D 8/1283 148/111 |

FOREIGN PATENT DOCUMENTS

| | | | |
|---|---|---|---|
| JP | 40-15644 | B2 | 7/1965 |
| JP | 51-13469 | B2 | 4/1976 |
| JP | 59-159989 | A | 9/1984 |
| JP | 62-1819 | A | 1/1987 |
| JP | 63-315521 | A | 12/1988 |
| JP | 3-6389 | A | 1/1991 |
| JP | 3-243795 | A | 10/1991 |
| JP | 2000-282271 | A | 10/2000 |
| JP | 2003-193141 | A | 7/2003 |
| JP | 2004-169179 | A | 6/2004 |
| JP | 2014-196559 | A | 10/2014 |
| JP | 2017-82276 | A | 5/2017 |
| JP | 2018-168426 | A | 11/2018 |
| JP | 2019-99827 | A | 6/2019 |
| JP | 2019-167568 | A | 10/2019 |
| JP | 2020-59050 | A | 4/2020 |

(Continued)

OTHER PUBLICATIONS

English translation of the Russian Office Action for corresponding Russian Application No. 2022134014/05, dated Jul. 11, 2023.
Gulyaev A.P., "Metallurgy," M., Metallurgy, 1986, pp. 88-99 (7 pages total).
Kemer O.V., "Methods for solving problems in the course of general chemistry: teaching aid/O.V. Kemer," Ulyanovsk, UVAU GA, 2007, p. 8, para. 6, p. 14, para. 5 (4 pages total).
Kuznetsov S.A., "The Big Explanatory Dictionary of the Russian Language," Norint, St. Petersburg, 1998, p. 1249 (3 pages total).
Sorokin V.G., Steels and alloys. Marochnik., M.: "Intermet engineering," 2001, p. 10 (3 pages total).

(Continued)

*Primary Examiner* — Jophy S. Koshy
(74) *Attorney, Agent, or Firm* — Birch, Stewart, Kolasch & Birch, LLP

(57) ABSTRACT

A new and improved method for producing electrical steel sheet enabling production of electrical steel sheet excellent in magnetic characteristics and coating film adhesion, the method for producing electrical steel sheet containing a process of bringing an electrical steel sheet containing, by mass %, C: more than 0% and 0.10% or less, Si: 2.5% or more and 4.5% or less, Mn: 0.01% or more and 5.0% or less, a total of one or more of S, Se, and Te: more than 0% and 0.050% or less, acid soluble Al: more than 0% and 5.0% or less, N: more than 0% and 0.015% or less, and P: more than 0% and 1.0% or less and having a balance of Fe and impurities into contact with a solution, the solution containing one or more elements from among Cu, Hg, Ag, Pb, Cd, Co, Zn, and Ni, a total of concentrations of the elements being 0.00001% or more and 1.0000% or less.

3 Claims, No Drawings

(56) References Cited

FOREIGN PATENT DOCUMENTS

RU 2 134 727 C1 8/1999

OTHER PUBLICATIONS

Zefirov N.S., Chemical encyclopedia, vol. 4, M.: Scientific publishing house, "Big Russian Encyclopedia," 1995, p. 184, col. 360 (4 pages total).

* cited by examiner

METHOD FOR PRODUCING ELECTRICAL STEEL SHEET

FIELD

The present invention relates to a method for producing electrical steel sheet.

BACKGROUND

Electrical steel sheet is generally classified into grain-oriented electrical steel sheet and non-oriented electrical steel sheet. Grain-oriented electrical steel sheet is steel sheet which contains Si in 2 mass % to 5 mass % or so and has grains of the steel sheet integrated in orientation to a high degree to the {110}<001> orientation called the "Goss orientation". Grain-oriented electrical steel sheet is excellent in magnetic characteristics and, for example, is utilized as the core material of transformers and other stationary induction apparatus etc. On the other hand, non-oriented electrical steel sheet, in the case of high grades, in the same way as grain-oriented electrical steel sheet, contains Si in 2 mass % to 5 mass % or so, but the crystal axis orientations of the crystals are arranged as randomly as possible so that magnetic characteristics leaning toward any specific orientation of the steel sheet are not exhibited. In the same way as grain-oriented electrical steel sheet, it is excellent in magnetic characteristics and, for example, is utilized as the core material of the stators and rotors of rotary machines.

In such electrical steel sheet, various techniques have been developed for improving the magnetic characteristics. In particular, along with the demands for energy-saving in recent years, further reduction of the core loss has been sought in electrical steel sheet. Core loss is comprised of eddy current loss and hysteresis loss.

For reducing the core loss of grain-oriented electrical steel sheet, raising the degree of integration of the orientation of the grains of the steel sheet to the Goss orientation to improve the magnetic flux density and reduce the hysteresis loss is effective.

Here, in the production of grain-oriented electrical steel sheet, the crystal orientation is controlled by utilizing the catastrophic grain growth phenomenon called "secondary recrystallization". However, to suitably control the crystal orientation by secondary recrystallization, it is important to improve the heat resistance of the microprecipitates in the steel called "inhibitors".

For example, the method of making the inhibitors completely dissolve at the time of heating the steel slab before hot rolling, then making them finely precipitate in the hot rolling and later annealing process may be mentioned. Specifically, the method such as illustrated in the following PTL 1 of using MnS and AlN as inhibitors and rolling by a rolling reduction of more than 80% in the final cold rolling process or the method such as illustrated in the following PTL 2 of using MnS and MnSe as inhibitors and performing a cold rolling process two times may be mentioned.

Further, as explained above, core loss includes eddy current loss. Whether oriented or non-oriented, by providing the surface of electrical steel sheet with an insulation coating, it becomes possible to suppress conduction between electrical steel sheets stacked as a core and reduce the eddy current loss of the core and becomes possible to further improve the practical magnetic characteristics of electrical steel sheet.

Further, to reduce the core loss, the art of subdividing the magnetic domains to reduce the eddy current loss and as a result lower the core loss is known. This action can also be particularly applied to grain-oriented electrical steel sheet.

PTLs 3 and 4 disclose the art of producing grain-oriented electrical steel sheet excellent in coating characteristics by controlling the conditions of hot rolled annealing and the pickling treatment conditions. Furthermore, PTL 5 discloses the art of controlling the pickling treatment conditions, additive conditions of annealing separators, and finish annealing conditions to produce grain-oriented electrical steel excellent in coating characteristics. PTL 6 discloses the art of improving the coating film adhesion of the insulating coating of non-oriented electrical steel sheet.

CITATIONS LIST

Patent Literature

[PTL 1] Japanese Examined Patent Publication No. 40-15644

[PTL 2] Japanese Examined Patent Publication No. 51-13469

[PTL 3] Japanese Unexamined Patent Publication No. 2003-193141

[PTL 4] Japanese Unexamined Patent Publication No. 2019-99827

[PTL 5] Japanese Unexamined Patent Publication No. 2014-196559

[PTL 6] Japanese Unexamined Patent Publication No. 2017-082276

SUMMARY

Technical Problem

Along with the increasing global regulation of the efficiency of transformers, demand for reduction of core loss in grain-oriented electrical steel sheet has grown much larger. On the other hand, transformers are important equipment supporting social infrastructure over the long term, so continued stable operation is important. For this reason, greater reliability contributing to stabler operation of transformers is being sought from the grain-oriented electrical steel sheet forming the main members. Further, due to the rising importance of the issue of the global environment in recent years, in electrical equipment, smaller size, higher output, and higher energy efficiency have been sought. In the core materials of motors, that is, non-oriented electrical steel sheets, as well, greater reliability contributing to stabler operation of motors has been demanded.

The above PTLs 3 to 5 disclose creating a difference in concentrations of Mn or Cu at the surface and at the center of thickness as methods for obtaining grain-oriented electrical steel sheet excellent in magnetic characteristics and/or excellent in coating film adhesion. Further, PTL 6 discloses making Cu and Ni segregate at the surface of the base steel material together with Sb and Sn as a method for obtaining non-oriented electrical steel sheet excellent in coating film adhesion. However, sometimes these magnetic characteristics and coating film adhesion have not been sufficient. Further improvement and ease of manufacture are being demanded.

Therefore, the present invention was made in consideration of the above problem. An object of the present invention is to provide a new and improved method for producing electrical steel sheet enabling production of electrical steel sheet excellent in magnetic characteristics and coating film adhesion. In this Description, "electrical steel sheet", unless otherwise indicated, may be either of grain-oriented electrical steel sheet or non-oriented electrical steel sheet.

Solution to Problem

To solve the above problem, according to the present invention, the following are provided:

[1] A method for producing electrical steel sheet containing a process of bringing an electrical steel sheet containing, by mass %, C: more than 0% and 0.10% or less, Si: 2.5% or more and 4.5% or less, Mn: 0.01% or more and 5.0% or less, a total of one or more of S, Se, and Te: more than 0% and 0.050% or less, acid soluble Al: more than 0% and 5.0% or less, N: more than 0% and 0.015% or less, and P: more than 0% and 1.0% or less and having a balance of Fe and impurities into contact with a solution, the solution containing one or more elements from among Cu, Hg, Ag, Pb, Cd, Co, Zn, and Ni, a total of concentrations of the elements being 0.00001% or more and 1.0000% or less.

[2] A method for producing electrical steel sheet according to [1], wherein the electrical steel sheet contains, in place of part of the Fe, one or more elements selected from the group comprising Cu: 1.0% or less, Sn: 1.0% or less, Ni: 1.0% or less, Cr: 1.0% or less, Sb: 1.0% or less, and Bi: 1.0% or less.

[3] A method for producing electrical steel sheet according to [1] or [2], wherein the process for bringing the electrical steel sheet into contact with the solution is a pickling process, the pH of the solution is −1.5 or more and less than 7, the solution temperature is 15° C. or more and 100° C. or less, and the time during which the electrical steel sheet contacts the solution is 5 seconds or more and 200 seconds or less.

[4] A method for producing electrical steel sheet according to any one of [1] to [3], wherein the process for bringing the electrical steel sheet into contact with the solution is performed at the hot rolling process or later and before the finish annealing process.

[5] A method for producing electrical steel sheet according to any one of [1] to [4], wherein the process for bringing the electrical steel sheet into contact with the solution is performed at the finish annealing process or later and before the insulation coating process.

Advantageous Effects of Invention

According to the present invention, a solution containing one or more elements from among Cu, Hg, Ag, Pb, Cd, Co, Zn, and Ni (in this Description, these will sometimes be referred to as "Cu etc.") and the electrical steel sheet are made to contact each other. The electrical steel sheet includes MnS, MnSe, and MnTe as precipitates (in this Description, these will sometimes be referred to as "MnS etc.") MnS and other precipitates act as inhibitors. In the present invention, if MnS etc. contact a solution containing Cu etc., part of the Mn at the MnS etc., in particular the Mn of the surface layers of the MnS etc., is substituted by Cu etc. By utilizing this phenomenon to improve the heat resistance of the precipitates, it is possible to improve the inhibitor strength of the grain-oriented electrical steel sheet and realize high magnetic characteristics.

Further, if bringing steel sheet containing MnS etc. at the surface of the steel sheet into contact with a solution containing Cu etc., it is possible utilize the phenomenon of Cu and other elements concentrating at the surface of the steel sheet due to the above phenomenon to realize the manifestation of the effect of control of magnetic domains by the improvement of the thermal conductivity, improvement of the coating film adhesion due to improvement of wettability by the coating solution, and improvement of the heat removal in stacked cores of transformers or motors. These effects can be enjoyed not only in grain-oriented electrical steel sheet, but also in non-oriented electrical steel sheet.

DESCRIPTION OF EMBODIMENTS

Below, preferred embodiments of the present invention will be explained in detail. Note that, unless otherwise indicated, the expression "A to B" for the numerical values A and B will mean "A or more and B or less". If assigning units to only the numerical value B in such an expression, the units shall also apply to the numerical value A.

Method for Producing Electrical Steel Sheet

The inventors discovered the following as a result of intensive study of the method for producing grain-oriented electrical steel sheet for improving adhesion between a coating film and steel sheet while improving the magnetic characteristics in electrical steel sheet.

Specifically, the inventors discovered that if making electrical steel sheet containing MnS etc. contact a solution containing Cu etc., part of the Mn at the MnS etc., in particular the Mn of the surface layers of the MnS etc., is substituted with Cu etc. and that by making use of this phenomenon, it is possible to improve the heat resistance of the MnS etc. and thereby improve the inhibitor strength and improve the magnetic characteristics.

Further, they discovered that if bringing electrical steel sheet containing MnS etc. at the surface of the steel sheet into contact with a solution containing Cu etc., it is possible to utilize the phenomenon of Cu and other elements concentrating at the surface of the steel sheet due to the above phenomenon to realize the manifestation of the effect of control of magnetic domains by the improvement of the thermal conductivity of the steel sheet, improvement of the coating film adhesion due to improvement of wettability by the coating solution, and improvement of the heat removal in stacked cores of transformers or motors.

The inventors considered the above discoveries and came up with the present invention. An embodiment of the present invention is a method for producing electrical steel sheet provided with the following constitution.

A method for producing electrical steel sheet containing a process of bringing an electrical steel sheet containing, by mass %, C: more than 0% and 0.10% or less, Si: 2.5% or more and 4.5% or less, Mn: 0.01% or more and 5.0% or less, a total of one or more of S, Se, and Te: more than 0% and 0.050% or less, acid soluble Al: more than 0% and 5.0% or less, N: more than 0% and 0.015% or less, and P: more than 0% and 1.0% or less and having a balance of Fe and impurities into contact with a solution, the solution containing one or more elements from among Cu, Hg, Ag, Pb, Cd, Co, Zn, and Ni, a total of concentrations of the elements being 0.00001% or more and 1.0000% or less.

Below, the method for producing the electrical steel sheet according to the present embodiment will be specifically explained.

Chemical Composition of Slab

First, the chemical composition of the electrical steel sheet according to the present embodiment will be explained. Note that, below, unless otherwise indicated, the expression "%" will be assumed to express "mass %". Further, the balance other than the elements explained below consists of Fe and impurities. Here, "impurities" indicate constituents contained in the raw materials or constituents entering in the process of production which are not intentionally contained in the steel sheet. Further, the chemical composition of the slab of the material of the electrical steel sheet is basically based on the composition of the electrical steel sheet. However, in the production of general electrical steel sheet, in particular grain-oriented electrical steel sheet, part of the contained elements is discharged outside of the system due to the decarburization annealing and purification annealing in the production process, so the chemical compositions of the material slab and the final product electrical steel sheet become different. The slab composition can be suitably adjusted considering the effects of the decarburization annealing and purification annealing in the production process so that the characteristics of the electrical steel sheet, in particular the grain-oriented electrical steel sheet, become the desired ones. Further, the expression "electrical steel sheet" in the present invention, unless otherwise indicated, shall mean electrical steel sheet in any of the processes from the slab to the final product in the process of production of electrical steel sheet. That is, the expression "electrical steel sheet" in the process of production of present invention, unless otherwise indicated, shall mean electrical steel sheet in any of the processes from the slab to before the process for coating the insulation coating in the process of production of electrical steel sheet.

The content of C (carbon) is more than 0% and 0.10% or less. C plays various roles, but if C is not contained (if it is 0%), at the time of heating the slab, the grain size becomes excessively large, whereby the core loss value of the final grain-oriented electrical steel sheet is made to increase, so this is not preferable. If the content of C is more than 0.10%, at the time of decarburization after cold rolling, the decarburization time becomes long and the production costs increase, so this is not preferable. Further, if the content of C is more than 0.10%, the decarburization easily becomes incomplete and there is a possibility of magnetic aging occurring in the final electrical steel sheet, so this is not preferable. Therefore, the content of C is more than 0% and 0.10% or less. In the case of production of grain-oriented electrical steel sheet, it is preferably 0.02% or more and 0.10% or less. More preferably, it is 0.05% or more and 0.09% or less.

The content of Si (silicon) is 2.5% or more and 4.5% or less. Si raises the electrical resistance of the steel sheet to thereby reduce the eddy current loss—which is one of the causes of core loss. If the content of Si is less than 2.5%, it becomes difficult to sufficiently suppress eddy current loss of the final electrical steel sheet, so this is not preferable. If the content of Si is more than 4.5%, the workability of the electrical steel sheet falls, so this is not preferable. Therefore, the content of Si is 2.5% or more and 4.5% or less, preferably 2.7% or more and 4.0% or less.

The content of Mn (manganese) is 0.01% or more and 5.0% or less. Mn forms the inhibitors MnS, MnSe, MnTe, etc. governing the secondary recrystallization. Further, Mn has the action of increasing the electrical resistance in the same way as Si and reduces the eddy current loss—which is one of the causes of core loss. If the content of Mn is less than 0.01%, the absolute amounts of MnS, MnSe, and MnTe causing the secondary recrystallization become insufficient, so this is not preferable. If the content of Mn is more than 5.0%, at the time of slab heating, the Mn becomes difficult to dissolve, so this is not preferable. Further, if the content of Mn is more than 5.0%, the precipitated size of the inhibitors MnS, MnSe, and MnTe easily becomes coarser and the optimal distribution of size as inhibitors is detracted from, so this is not preferable. Therefore, the content of Mn is 0.01% or more and 5.0% or less, In the case of production of grain-oriented electrical steel sheet, it is preferably 0.01% or more and 0.50% or less, more preferably 0.01% or more and 0.30% or less, still more preferably 0.03% or more and 0.15% or less. It may be made the above content from the viewpoint of reduction of the core loss (eddy current loss) as well.

The total content of the one or more elements from among S (sulfur), Se (selenium), and Te (tellurium) is a total of more than 0% and 0.050% or less. S, Se, and Te form inhibitors together with the above-mentioned Mn. All of the three of S, Se, and Te may be included in the electrical steel sheet, but it is sufficient that at least one of any of them be contained in the electrical steel sheet. If the total of the contents of S, Se, and Te is outside the above range, a sufficient inhibitor effect cannot be obtained, so this is not preferable. However, in the case of non-oriented electrical steel sheet, inhibitors are unnecessary, so the less the better. 0% is preferable, but rendering the content 0% sometimes requires higher costs, so the content is made more than 0%. Further, if more than the above upper limit, MnS and other sulfides precipitate in large amounts and the increase in core loss becomes remarkable. Therefore, the content of one or more elements among S, Se, and Te is a total of more than 0% and 0.050% or less, preferably 0.001% or more and 0.040% or less.

The content of acid soluble Al (acid soluble aluminum) is more than 0% and 5.0% or less. The acid soluble Al forms the inhibitors (AlN) useful for producing high magnetic flux density electrical steel sheet, in particular grain-oriented electrical steel sheet. Further, Al has the action of increasing the electrical resistance in the same way as Si and reduces the eddy current loss—one of the causes of core loss. If the content of acid soluble Al is 0, sometimes no AlN is present, the inhibitor strength becomes insufficient, and good magnetic characteristics cannot be obtained, so this is not preferable. If the content of acid soluble Al is more than 5.0%, the AlN precipitating as inhibitors becomes coarser and causes the inhibitor strength to drop, so this is not preferable. Therefore, the content of acid soluble Al is more than 0% and 5.0% or less, in the case of production of grain-oriented electrical steel sheet, preferably more than 0% and 0.05% or less, more preferably more than 0% and 0.04% or less.

The content of N (nitrogen) is more than 0% and 0.015% or less. N forms the inhibitor AlN together with the above-mentioned acid soluble Al. If the content of N is outside the above range, a sufficient inhibitor effect cannot be obtained and sometimes good magnetic characteristics cannot be obtained, so this is not preferable. Further, if more than the above upper limit, the increase in core loss becomes remarkable due to the increase in nitrides. Therefore, the content of N is more than 0% and 0.015% or less, preferably more than 0% and 0.012% or less.

The content of P (phosphorus) is more than 0% and 1.0% or less. P has the action of raising the strength without causing a drop in the magnetic flux density. However, if causing P to be excessively contained, the toughness of the steel becomes impaired and the steel sheet easily breaks. For this reason, the upper limit of the amount of P is made 1.0%. Preferably it is 0.150% or less, more preferably 0.120% or less. The lower limit of the amount of P is not particularly limited, but if considering the production costs, it becomes 0.001% or more.

Further, the slab used for the production of electrical steel sheet according to the present embodiment, in particular grain-oriented electrical steel sheet, may contain one or more elements of any of Cu, Sn, Ni, Cr, Sb, or Bi as elements stabilizing the secondary recrystallization in individual contents of 0% or more and 1.0% or less in addition to the above-mentioned elements. The contents of these elements are preferably individual contents of 0.0005% or more and 0.3000% or less. If the slab contains the above elements, the magnetic flux density of electrical steel sheet produced, in particular grain-oriented electrical steel sheet, can be further improved.

The slab is formed by casting molten steel adjusted so that the electrical steel sheet becomes the chemical composition explained above. Note that, the method of casting the slab is not particularly limited. Further, in R&D, even if a steel ingot is formed by a vacuum melting furnace etc., a similar effect as the case where the slab is formed for the above constituents can be confirmed.

Process for Forming Hot Rolled Steel Sheet

Next, the slab is heated and hot rolled to work it into a hot rolled steel sheet. The slab heating temperature is not particularly limited. If making the inhibitor constituents in the slab completely dissolve, for example, it may be heated to 1280° C. or more. Note that, the upper limit value of the heating temperature of the slab at this time is not particularly prescribed, but from the viewpoint of protection of the facilities, 1450° C. is preferable. For example, the heating temperature of the slab may be 1280° C. or more and 1450° C. or less. On the other hand, if not making the inhibitor constituents in the slab completely dissolve, for example, the heating temperature of the slab may be less than 1280° C. In this case, the steel sheet may also be nitrided in any process from the hot rolled annealing process to the finish annealing process. Further, in the case of non-oriented electrical steel sheet, at the time of slab heating, the S compounds, N compounds, etc. redissolve, but to avoid their subsequent fine precipitation and deterioration of the magnetic characteristics, the usual slab heating temperature may be 1150° C. or less, preferably 1100° C. or less, more preferably 1050° C. or less.

Next, the heated slab is hot rolled to work it to hot rolled steel sheet. The thickness of the worked hot rolled steel sheet may, for example, be 1.8 mm or more and 3.5 mm or less. If the thickness of the hot rolled steel sheet is less than 1.8 mm, sometimes the shape of the steel sheet after hot rolling becomes poor, so this is not preferable. If the thickness of the hot rolled steel sheet is more than 3.5 mm, the rolling load in the process of cold rolling becomes larger, so this is not preferable.

Process for Forming Cold Rolled Steel Sheet

Next, the obtained hot rolled steel sheet is annealed, then is worked into a cold rolled sheet by a single cold rolling operation or several cold rolling operations with process annealing interposed. Note that, if rolling by a plurality of cold rolling operations with process annealing interposed, it is also possible to omit the previous stage hot rolled annealing. However, if annealing the hot rolled sheet, the shape of the steel sheet becomes better, so it is possible to reduce the possibility of the steel sheet breaking due to cold rolling. Note that, before being sent to cold rolling, it is preferable to perform pickling to remove the scale etc. deposited on the surface of the steel sheet. For control of the inhibitors in the thickness direction explained later, pickling need only be performed at least once at the hot rolling or later and before the primary recrystallization annealing. If rolling by a plurality of cold rolling operations, from the viewpoint of reducing roll wear in cold rolling, it is preferable to perform the pickling treatment before the individual cold rolling processes.

Further, the steel sheet may be heat treated at 300° C. or so or less between passes of cold rolling, between rolling stands, or during rolling. In such a case, the magnetic characteristics of the final grain-oriented electrical steel sheet can be improved. Note that, the hot rolled steel sheet may be rolled by cold rolling three times or more, but a large number of cold rolling operations increases the production costs, so the hot rolled steel sheet is preferably rolled by one or two cold rolling operations. If performing the cold rolling by Sendzimir or other reverse rolling, the number of passes in the cold rolling operations is not particularly limited, but from the viewpoint of production costs, nine passes or less is preferable.

Process of Making Electrical Steel Sheet Contact Solution

The method for producing the electrical steel sheet of the present invention is characterized by making the electrical steel sheet contact a solution containing one or more elements from among Cu, Hg, Ag, Pb, Cd, Co, Zn, and Ni (in the present Description, these sometimes being referred to as the "Cu etc.") and having a total of concentrations of the elements of 0.00001% or more and 1.0000% or less (in the present Description, sometimes referred to as the "solution contact treatment" or "solution contact process").

The electrical steel sheet contains MnS, MnSe, and MnTe (in the present Description, these sometimes being referred to as "MnS etc.") as precipitates. These precipitates act as inhibitors. In the present invention, if MnS etc. contact a solution containing Cu etc., part of the Mn in the MnS etc., in particular the Mn at the surface layers of the MnS etc., is substituted by the Cu etc. By improving the heat resistance of the precipitates by this phenomenon, it is possible to improve the inhibitor strength of the grain-oriented electrical steel sheet and realize high magnetic characteristics.

Further, it is possible to utilize the phenomenon of Cu and other elements concentrating at the surface of the steel sheet by this phenomenon to realize manifestation of the effect of control of magnetic domains by improvement of the thermal conductivity, improvement of the coating film adhesion by improvement of the wettability of the coating solution, and improvement of heat removal in stacked cores of transformers and motors. These effects can be enjoyed not only in grain-oriented electrical steel sheet, but also in non-oriented electrical steel sheet.

The mechanism by which control of the inhibitors in the thickness direction becomes possible by making a solution containing Cu etc. contact electrical steel sheet is presumed to be as follows: If making the solution contain one or more elements from among Cu, Hg, Ag, Pb, Cd, Co, Zn, and Ni, since these elements are extremely high in affinity with the S, Se, and Te in the solution, they substitute the Mn of the MnS, MnSe, and MnTe precipitates exposed at the surface of the steel sheet and form compounds. This reaction easily occurs at the MnS and other precipitates, in particular the surface sides contacting the solution. It is believed that if Mn is substituted by other metal elements (Cu etc.) at the surface sides of the MnS and other precipitates, these surface side compounds act as barriers keeping the Mn and S, Se, and Te at the center sides of the MnS and other precipitates from dissolving into the steel, so Ostwald ripening of the MnS etc. at the finish annealing process is suppressed and the heat resistance of the MnS and other precipitates, that is, the inhibitor strength, rises. This reaction occurs if a solution containing one or more elements from among Cu, Hg, Ag, Pb, Cd, Co, Zn, and Ni contacts the MnS, MnSe and MnTe.

Therefore, it is believed that if there are cracks, voids, or other defects at the surface layer of the steel sheet, the solution passes through these spaces to infiltrate the steel sheet and reacts with not only the MnS etc. exposed at the surface-most part of the steel sheet, but also the MnS etc. in a range of a certain depth of the surface layer of the steel sheet to raise the inhibitor strength. Before the solution contact of the electrical steel sheet, it is also possible to perform shot blasting treatment etc. to introduce cracks and other defects to the surface of the steel sheet for the purpose of raising the inhibitor strength of MnS etc. in the range of a certain depth. Further, in addition to the rise in the heat resistance, that is, inhibitor strength, explained above, it is possible to use the concentrated Cu and other elements to realize the manifestation of the effect of control of magnetic domains by the improvement of the thermal conductivity, improvement of the coating film adhesion due to improvement of wettability by the coating solution, and improvement of the heat removal in stacked cores of transformers or motors.

If the total of the one or more elements among the Cu, Hg, Ag, Pb, Cd, Co, Zn, and Ni of the solution is less than 0.00001%, the effect of control of the inhibitors in the thickness direction and the effects resulting from concentration of Cu etc. such as the manifestation of the effect of control of the magnetic domains, improvement of the coating film adhesion, and improvement of heat removal become insufficient, so this is not preferable. If the total of the one or more elements among the Cu, Hg, Ag, Pb, Cd, Co, Zn, and Ni of the solution is more than 1.0000%, the effect of improvement of the magnetic characteristics becomes saturated, so this is not preferable. Therefore, the total of the one or more elements among the Cu, Hg, Ag, Pb, Cd, Co, Zn, and Ni of the solution is 0.00001% or more and 1.0000% or less.

Further, in general, the pH of the solution is preferably lower. A solution with a low pH has a pickling effect. It is believed that the solution reacts with not only the MnS etc. exposed at the surface-most part of the steel sheet, but also the MnS etc. in a range of a certain depth of the surface layer of the steel sheet so as to raise the inhibitor strengthening and further promote the concentration of Cu etc. However, if the pH of the solution is less than −1, the acidity becomes too strong and handling of the solution becomes difficult, so this is not preferable. If the pH of the solution is 7 or more, sometimes the effect of the pickling treatment is not sufficiently obtained and the effect of control of the inhibitors in the thickness direction becomes insufficient. Therefore, the pH of the solution may be made −1.5 or more and less than 7. The lower the pH of the solution, the higher the pickling effect and the more strengthening by the inhibitors is promoted, so the pH of the solution is preferably −1.5 or more and 6 or less, more preferably −1.5 or more and 5 or less. Note that, as the acid constituent which the solution contains, sulfuric acid, hydrochloric acid, nitric acid, phosphoric acid, etc. may be illustrated.

Further, if the temperature of the solution is less than 15° C., the effect of the pickling treatment cannot be sufficiently obtained and sometimes the effect of control of the inhibitors in the thickness direction becomes insufficient. If the temperature of the solution is more than 100° C., sometimes handling of the solution becomes difficult. Therefore, the temperature of the solution may be made 15° C. or more and 100° C. or less.

Further, if the time during which the steel sheet contacts the solution is less than 5 seconds, the contact time is not sufficient and sometimes the effects of the pickling and inhibitor strengthening and the Cu concentration etc. become insufficient. If the time during which the steel sheet contacts the solution is more than 200 seconds, the facilities for causing contact become long and large, so this is not preferable. Therefore, the time during which the steel sheet contacts the solution may be made 5 seconds or more and 200 seconds or less.

Therefore, the process of making the electrical steel sheet contact a solution (solution contact process) may be a pickling process. The above pH value, solution temperature, and contact time (pickling time) may be employed as the pickling conditions. In general, in the process of production of steel sheet, pickling treatment is performed before the later processes for the purpose of removing scale, cleaning the surface of the steel sheet, etc. Typically, from the viewpoint of decreasing roll wear in cold rolling, the pickling treatment may also be performed before the individual cold rolling processes. Further, from the viewpoint of controlling the oxidation of the surface of the steel sheet in the primary recrystallization annealing, the pickling treatment may also be applied before the primary recrystallization annealing. Furthermore, from the viewpoint of improvement of the coatability of the annealing separator, the pickling treatment may also be applied before the finish annealing. In particular, from the viewpoint of improving the coatability of the insulation coating, the pickling treatment may be applied before the flattening annealing. These pickling treatments may also be applied combined.

Note that, the effect of improvement of the heat resistance of the inhibitors (precipitates) due to the present art etc. can also be obtained in application to other types of steel. For example, they may also be applied to non-oriented electrical steel sheet. In the case of application to other types of steel, the slab constituents and process conditions are not limited to the above.

Method for Confirming Surfaces of "MnS Etc." Precipitates Substituted by "Cu Etc."

The method for confirming that the surfaces of the MnS and other precipitates are substituted by Cu etc. will be explained.

First, the steel sheet sample to be confirmed is polished to a mirror finish and examined by an SEM-EDX. In the observed image obtained by the SEM, the presence of MnS and other precipitates can be confirmed. At the examined image, element mapping of EDX of the Cu etc., for example, Mn, S, and Cu, and the strength ratio are superposed. Due to this, it is possible to confirm the constituent elements of the precipitate particles. In a typical example, if examining the precipitate particles and their vicinities, the mapping strength ratio of the Mn and S rises at the parts of the precipitate particles, so it can be confirmed that the particles are MnS particles. Furthermore, if the mapping strength ratio of Cu also rises at the part near the surface of the particles, it is presumed that the surface of the precipitates is substituted by Cu.

Furthermore, the state of distribution of elements in the precipitate particles is confirmed by Auger electron spectroscopy. More specifically, by sputtering by Ar the surface layers of the MnS and other precipitates by Auger electron spectroscopy at several nm intervals (typically 1 nm intervals) while analyzing the elements, it is possible to confirm the distribution of constituent elements from the surface layer parts of the precipitated particles toward the inside. If Cu etc. is detected at a high concentration only at the surface layer parts of the MnS or other precipitates and the concentration of Cu etc. falls at the insides of the precipitates, it is possible to deem that the surfaces of the precipitates have been substituted by Cu etc.

The apparatus and the measurement conditions used for the SEM, EDS, and Auger electron spectroscopy can be suitably selected in accordance with the measured object. In the analysis in this Description, for the SEM apparatus, an FE-SEM Model JEOL7001F made by JEOL is used by a WD of 10 mm and acceleration voltage of 15 kV. For the Auger electron spectroscopy analyzer, an FE-AES PHI-700 made by PHE is used by an electron beam: 10 kV, 10 nA, and ion beam: Ar/2 kV.

Primary Recrystallization Annealing Process Next, the cold rolled steel sheet is raised in temperature, then annealed for decarburization. These processes are called "primary recrystallization annealing" and are preferably performed consecutively. Further, between the temperature rise and decarburization annealing, intermediate treatment may be performed for improving the coating characteristics by suppression of uneven color etc.

The decarburization annealing may also be performed in a wet atmosphere containing hydrogen and nitrogen at a temperature of 900° C. or less. Here, to keep the decarburization from being obstructed, the oxygen partial pressure ratio of the decarburization annealing, that is, the ratio $P_{H2O}/P_{H2}$ of the water vapor partial pressure $P_{H2O}$ and the hydrogen partial pressure $P_{H2}$ in the atmosphere, may be made 0.35 or more.

Note that, in the process of primary recrystallization annealing, reduction annealing may be performed after decarburization annealing for the purpose of improving the magnetic characteristics and coating film adhesion of the cold rolled steel sheet.

Finish Annealing Process

After that, the cold rolled steel sheet after the primary recrystallization annealing is treated by finish annealing. At this time, an annealing separator containing MgO as its main constituent may be coated before the finish annealing for the purpose of preventing the steel sheets from sticking to each other, forming a primary coating, controlling the behavior of the secondary recrystallization, etc. The annealing separator is generally coated on the surface of the steel sheet in the state of an aqueous slurry and dried, but the electrostatic coating method etc. may also be used. Here, it is also possible to add a sulfide or sulfate compound, nitride, etc. to the MgO to cause sulfur or nitrogen etc. to infiltrate the steel sheet during the following finish annealing and control the secondary recrystallization through control of inhibitors.

Next, finish annealing is performed for the purpose of forming the primary coating and secondary recrystallization. The finish annealing may, for example, be performed by heat treating the steel sheet in the coil state using a batch type heating furnace etc. Furthermore, to better reduce the core loss value of the final electrical steel sheet, purification treatment may be performed raising the temperature of the steel sheet in the coil state up to 1200° C. or so in temperature, then holding it there.

In finish annealing, the temperature is generally raised from room temperature or so. Further, there are various rates of temperature rise in finish annealing, but the rate is not particularly limited in the present invention. The conditions of general finish annealing can be used. For example, from the viewpoint of the productivity and general restriction on facilities, 5° C./h to 100° C./h is also possible. Further, this may be performed by other known heat patterns.

In the cooling process as well, the heat pattern is not particularly limited. The composition of the atmospheric gas in the finish annealing is not particularly limited. In the process of progression of secondary recrystallization, the gas may also be a mixed gas of nitrogen and hydrogen. The atmosphere may be a dry atmosphere or may be a wet atmosphere. The purification annealing may be performed in dry hydrogen gas.

The fact that if making a solution containing one or more elements from among Cu, Hg, Ag, Pb, Cd, Co, Zn, and Ni in specific concentrations contact electrical steel sheet, the coating film adhesion is improved was discovered by the inventors.

While not constrained to a specific theory, the effect is believed to arise due to the following mechanism. At part of the MnS, MnSe, and MnTe at the surface layer side of the steel sheet, Mn is substituted by the Cu and other elements (Cu etc.) whereby these elements become more concentrated. Mn is an element with a thermal conductivity relatively lower than the Cu and other elements. Therefore, at the locations where Mn is substituted by Cu etc., the thermal conductivity rises and thermal conduction is promoted by the heating in the primary recrystallization annealing and finish annealing, so that temperature distribution at the steel sheet easily becomes even, surface roughness of the surface of the steel sheet is suppressed, the coating solution of the coating film in the subsequent process of the coating process is improved in wettability, and uniform coating becomes possible. It is believed that even at the stage where a coating film is formed by baking etc., the temperature distribution due to the heating and the coated state of the coating solution become uniform, so the coating film adhesion is improved. Note that, even if part of the MnS, MnSe, and MnTe is present in forsterite or other coating film, a similar effect can be obtained.

Further, due to the improvement of the thermal conductivity, improvement of heat removal at the stacked cores of transformers and motors is also realized.

Therefore, the process for making electrical steel sheet contact a solution containing one or more elements from among Cu, Hg, Ag, Pb, Cd, Co, Zn, and Ni in specific concentrations may be performed from the finish annealing process or later and before the insulation coating process. Due to this, it is possible to improve the adhesion of the insulation coating.

Flattening Annealing Process

Coating of Insulation Coating

Next, for the purpose of imparting insulation ability and tension to the steel sheet after the finish annealing, for example, an insulation coating having aluminum phosphate or colloidal silica etc. as its main constituent is coated on the surface of the steel sheet.

Flattening Annealing

After that, flattening annealing is performed for the purpose of baking on the insulation coating and flattening the shape of the steel sheet resulting from the finish annealing. Note that, the constituents of the insulation coating are not particularly limited so long as an insulation ability and tension are imparted to the steel sheet. Note that, in the present embodiment, needless to say, depending on the purpose of the user, the grain-oriented electrical steel sheet may also be treated to control the magnetic domains.

According to the method of production according to the present embodiment, a solution containing one or more elements from among Cu, Hg, Ag, Pb, Cd, Co, Zn, and Ni in specific concentrations is made to contact electrical steel sheet whereby at part of the MnS, MnSe, and MnTe at the surface layer side of the steel sheet, Mn is substituted by these elements and the thermal conductivity is improved. As the treatment for control of the magnetic domains, if inputting heat by laser or electron beam etc., the thermal conductivity is improved, whereby even heat input is possible and the manifestation of the effect of control of magnetic domains is promoted. On this point, the process for making the electrical steel sheet contact the solution containing one or more elements from among Cu, Hg, Ag, Pb, Cd, Co, Zn, and Ni in specific concentrations is preferably performed before the treatment for control of the magnetic domains. The process for contact with the acid may also be performed before the finish annealing in accordance with the timing of the treatment for control of the magnetic domains and may be performed after the finish annealing.

It is possible to produce the final electrical steel sheet by the above process. According to the method of production according to the present embodiment, it is possible to produce grain-oriented electrical steel sheet excellent in magnetic characteristics and coating film adhesion.

From the viewpoint of excellent magnetic characteristics, in the electrical steel sheet according to the present embodiment, further, the magnetic flux density B8 value may also be controlled. Specifically, in the electrical steel sheet according to the present embodiment, the magnetic flux density B8 value is preferably 1.90 T, more preferably 1.91 T or more, still more preferably 1.92 T or more, and even still more preferably 1.93 T or more. Here, the magnetic flux density B8 value is the magnetic flux density when applying a magnetic field of 800 A/m by 50 Hz to the electrical steel sheet. If the magnetic flux density B8 value is less than 1.90 T, the core loss value of the electrical steel sheet (in particular, the hysteresis loss) ends up becoming larger, so this is not preferable. The upper limit value of the magnetic flux density B8 value is not particularly limited, but practically it may be, for example, 2.0 T. Note that, the magnetic flux density and other magnetic characteristics of electrical steel sheet can be measured by known methods. For example, the magnetic characteristics of electrical steel sheet can be measured by using the method based on the Epstein test prescribed in JIS C2550 or the single sheet magnetic characteristic test method prescribed in JIS C2556 (Single Sheet Tester: SST) etc. Note that, in R&D, if a steel ingot is formed in a vacuum melting furnace etc., it becomes difficult to obtain a test piece of an equivalent size as actual production. In this case, for example, it is also possible to obtain a test piece of a width 60 mm×length 300 mm and measure the characteristics based on the single sheet magnetic characteristic test method. Furthermore, it is also possible to multiply the obtained results by a correction coefficient so that measurement values equal to the method based on the Epstein test are obtained. In the present embodiment, measurement is performed by a measurement method by the single sheet magnetic characteristic test method.

The thus obtained electrical steel sheet is worked into a wound core or stacked core when producing a transformer or motor. High coating film adhesion and the absence of peeling etc. at the time of working and the time of long-term operation and suppression of dust emission at the time of slitting are important factors in obtaining trust from users. In particular, an insulation coating not only secures the insulation between the steel sheets, but also functions to impart tension to the surface of the steel sheet. The coating film adhesion between the primary coating and insulation coating is important. From the viewpoint of excellent coating film adhesion, in one embodiment of the present invention, a test piece having a length of 300 mm in the rolling direction and 30 mm in the direction perpendicular to rolling is taken from the obtained electrical steel sheet, adhesive tape is adhered to the surface of the steel sheet, then the test piece is pressed against a rod having various diameter while bending it 180°, then the adhesive tape is peeled off. The test piece is evaluated by the smallest diameter at which no insulation coating sticks to the bent part of the adhesive tape at that time. The smaller the smallest diameter of bend peeling, the better the adhesion of the insulation coating. In normal applications, 20 mm or less is sought. If the smallest diameter is 10 mm or less, it may be judged that the sheet is excellent in bend adhesion. Note that, it is also possible to use, for example, a transparent tape as the adhesive tape to enable easy detection of the peelability of the insulation coating. Note that, the effect of improvement of the adhesion of the insulation coating according to the present art can be applied to other steel types. For example, the effect may also be obtained in non-oriented electrical steel sheet.

Above, the electrical steel sheet according to the present embodiment was explained. The electrical steel sheet according to the present embodiment can be produced by the method for producing electrical steel sheet of the above-mentioned present embodiment. However, the invention is not limited to only this method.

EXAMPLES

Below, while showing examples, a method for producing electrical steel sheet and electrical steel sheet according to the embodiment of the present invention will be explained in more detail. Note that, the examples shown below are just illustrations of the electrical steel sheet according to the embodiment. The electrical steel sheet according to the present embodiment is not limited to the examples shown below.

Example 1

First, a steel ingot containing C: 0.04%, Si: 3.3%, Mn: 0.10%, S: 0.001%, Se: 0.001%, Te: 0.001%, acid soluble Al: 0.005%, N: 0.003%, and P: 0.007% and having a balance of Fe and impurities was prepared. The steel ingot was annealed at 1200° C. for 1 hour, then was hot rolled to thereby obtain thickness 2.3 mm hot rolled steel sheets. The obtained hot rolled sheet sheets were annealed at a peak temperature of 1000° C. for 140 seconds, pickled, then process annealed and treated by solution contact (serving also as pickling) between two cold rolling processes to thereby obtain thickness 0.23 mm cold rolled steel sheets. Here, the conditions of the solution contact treatment (pickling condition) after process annealing are the conditions shown in Table 1.

Next, the obtained cold rolled steel sheets were annealed for primary recrystallization in a wet hydrogen atmosphere and 850° C. for 180 seconds. Next, the surfaces of the steel sheets after primary recrystallization annealing were coated with an annealing separator containing MgO in the state of an aqueous slurry and then dried. After that, these were finish annealed and the finish annealed steel sheets were rinsed. After that, the surfaces of the steel sheets were coated with an insulation coating having aluminum phosphate and colloidal silica as its main constituents, then were annealed for flattening for the purpose of baking on the insulation coating and flattening the steel sheets.

Samples of grain-oriented electrical steel sheets obtained by the above were cut and annealed to remove strain, then the single sheet magnetic characteristic measurement method for a sample size of 60 mm×300 mm (based on the method described in JIS C2556) was used to measure the magnetic flux density B8 values of the grain-oriented electrical steel sheets according to the invention examples and comparative examples. Here, the B8 value is the magnetic flux density of a steel sheet when exciting a grain-oriented electrical steel sheet by 50 Hz at 800 A/m. In the present invention, the average value of five samples was used.

Here, a condition where the magnetic flux density B8 value of the grain-oriented electrical steel sheet became 1.90 T or more was judged as good (B) and a condition where the magnetic flux density B8 value became 1.91 T or more was judged as the best (A). Further, conditions other than the above were judged as poor (C).

The production conditions, measurement results, and evaluations of the above present examples and comparative examples are shown in Table 1.

mm cold rolled steel sheets. Here, the conditions of the solution contact treatment (pickling condition) after hot rolled annealing are the conditions shown in Table 2.

Next, the obtained cold rolled steel sheets were annealed for primary recrystallization in a wet hydrogen atmosphere and 850° C. for 180 seconds. Next, the surfaces of the steel sheets after primary recrystallization annealing were coated with an annealing separator containing MgO in the state of an aqueous slurry and then dried. After that, these were finish annealed and the finish annealed steel sheets were rinsed. After that, the surfaces of the steel sheets were coated with an insulation coating having aluminum phosphate and colloidal silica as its main constituents, then was annealed for flattening for the purpose of baking on the insulation coating and flattening the steel sheets.

TABLE 1

| | Solution treatment condition | | | | | | Magnetic | | |
|---|---|---|---|---|---|---|---|---|---|
| Condition | Metal type | Metal type concentration (%) | Solution (Base) | pH | Solution temperature (° C.) | Contact time of solution and steel sheet (s) | flux density B8 value (T) | Evaluation | Remarks |
| A1 | Cu | 0.000005 | Hydrochloric acid | 3 | 70 | 30 | 1.893 | C | Comp. inv. |
| A2 | Cu | 0.000010 | Hydrochloric acid | 3 | 70 | 30 | 1.900 | B | Present inv. |
| A3 | Cu | 0.00010 | Hydrochloric acid | 3 | 70 | 30 | 1.911 | A | Present inv. |
| A4 | Cu | 0.01000 | Hydrochloric acid | 3 | 70 | 30 | 1.915 | A | Present inv. |
| A5 | Cu | 0.10000 | Hydrochloric acid | 3 | 70 | 30 | 1.916 | A | Present inv. |
| A6 | Cu | 1.00000 | Hydrochloric acid | 3 | 70 | 30 | 1.916 | A | Present inv. |
| A7 | Cu | 0.00100 | Hydrochloric acid | 0 | 70 | 30 | 1.916 | A | Present inv. |
| A8 | Cu | 0.00100 | Hydrochloric acid | 3 | 70 | 30 | 1.915 | A | Present inv. |
| A9 | Cu | 0.00100 | Hydrochloric acid | 5 | 70 | 30 | 1.913 | A | Present inv. |
| A10 | Cu | 0.00100 | Hydrochloric acid | 6 | 70 | 30 | 1.912 | A | Present inv. |
| A11 | Cu | 0.00100 | Hydrochloric acid | 7 | 70 | 30 | 1.902 | B | Present inv. |
| A12 | Cu | 0.00100 | Hydrochloric acid | 3 | 10 | 30 | 1.903 | B | Present inv. |
| A13 | Cu | 0.00100 | Hydrochloric acid | 3 | 15 | 30 | 1.911 | A | Present inv. |
| A14 | Cu | 0.00100 | Hydrochloric acid | 3 | 50 | 30 | 1.912 | A | Present inv. |
| A15 | Cu | 0.00100 | Hydrochloric acid | 3 | 100 | 30 | 1.915 | A | Present inv. |
| A16 | Cu | 0.00100 | Hydrochloric acid | 3 | 70 | 3 | 1.902 | B | Present inv. |
| A17 | Cu | 0.00100 | Hydrochloric acid | 3 | 70 | 5 | 1.911 | A | Present inv. |
| A18 | Cu | 0.00100 | Hydrochloric acid | 3 | 70 | 10 | 1.912 | A | Present inv. |
| A19 | Cu | 0.00100 | Hydrochloric acid | 3 | 70 | 100 | 1.916 | A | Present inv. |
| A20 | Cu | 0.00100 | Hydrochloric acid | 3 | 70 | 200 | 1.916 | A | Present inv. |
| A21 | Hg | 0.00100 | Hydrochloric acid | 3 | 70 | 30 | 1.915 | A | Present inv. |
| A22 | Ag | 0.00100 | Hydrochloric acid | 3 | 70 | 30 | 1.916 | A | Present inv. |
| A23 | Pb | 0.00100 | Hydrochloric acid | 3 | 70 | 30 | 1.915 | A | Present inv. |
| A24 | Cd | 0.00100 | Hydrochloric acid | 3 | 70 | 30 | 1.915 | A | Present inv. |
| A25 | Co | 0.00100 | Hydrochloric acid | 3 | 70 | 30 | 1.916 | A | Present inv. |
| A26 | Zn | 0.00100 | Hydrochloric acid | 3 | 70 | 30 | 1.915 | A | Present inv. |
| A27 | Ni | 0.00100 | Hydrochloric acid | 3 | 70 | 30 | 1.915 | A | Present inv. |
| A28 | Cu + Ni | 0.00100 | Hydrochloric acid | 3 | 70 | 30 | 1.915 | A | Present inv. |
| A29 | Ag + Co + Zn | 0.00100 | Hydrochloric acid | 3 | 70 | 30 | 1.916 | A | Present inv. |
| A30 | Cu | 0.10000 | Sulfuric acid | 2.5 | 70 | 30 | 1.915 | A | Present inv. |
| A31 | Cu | 0.10000 | Nitric acid | 2.5 | 70 | 30 | 1.915 | A | Present inv. |
| A32 | Cu | 0.10000 | Phosphoric acid | 2.5 | 70 | 30 | 1.914 | A | Present inv. |

Referring to the results of Table 1, it was learned that grain-oriented electrical steel sheets satisfying the conditions of the present embodiment were judged to be good.

Example 2

First, a steel ingot containing C: 0.08%, Si: 3.3%, Mn: 0.08%, S: 0.026%, acid soluble Al: 0.03%, N: 0.008%, and P: 0.005% and having a balance of Fe and impurities was prepared. The steel ingot was annealed at 1350° C. for 1 hour, then was hot rolled to thereby obtain thickness 2.3 mm hot rolled steel sheets. The obtained hot rolled sheet sheets were annealed at a peak temperature of 1100° C. for 140 seconds and treated by solution contact (serving also as pickling), then cold rolled to thereby obtain thickness 0.23

Samples of grain-oriented electrical steel sheets obtained by the above were cut and annealed to remove strain, then the single sheet magnetic characteristic measurement method for a sample size of 60 mm×300 mm (based on the method described in JIS C2556) was used to measure the magnetic flux density B8 values of the grain-oriented electrical steel sheets according to the invention examples and comparative examples. Here, the B8 value is the magnetic flux density of a steel sheet when exciting a grain-oriented electrical steel sheet by 50 Hz at 800 A/m. In the present invention, the average value of five samples was used.

Here, a condition where the magnetic flux density B8 value of the grain-oriented electrical steel sheet became 1.91 T or more was judged as good (B) and a condition where the magnetic flux density B8 value became 1.92 T or more was judged as the best (A). Further, conditions other than the above were judged as poor (C).

The production conditions, measurement results, and evaluations of the above present examples and comparative examples are shown in Table 2.

TABLE 2

| | Solution treatment condition | | | | | | Magnetic | | |
|---|---|---|---|---|---|---|---|---|---|
| Condition | Metal type | Metal type concentration (%) | Solution (Base) | pH | Solution temperature (° C.) | Contact time of solution and steel sheet (s) | flux density B8 value (T) | Evaluation | Remarks |
| B1 | Cu | 0.000005 | Hydrochloric acid | 3 | 70 | 30 | 1.902 | C | Comp. inv. |
| B2 | Cu | 0.000010 | Hydrochloric acid | 3 | 70 | 30 | 1.910 | B | Present inv. |
| B3 | Cu | 0.00010 | Hydrochloric acid | 3 | 70 | 30 | 1.922 | A | Present inv. |
| B4 | Cu | 0.01000 | Hydrochloric acid | 3 | 70 | 30 | 1.925 | A | Present inv. |
| B5 | Cu | 0.10000 | Hydrochloric acid | 3 | 70 | 30 | 1.926 | A | Present inv. |
| B6 | Cu | 1.00000 | Hydrochloric acid | 3 | 70 | 30 | 1.926 | A | Present inv. |
| B7 | Cu | 0.00100 | Hydrochloric acid | 0 | 70 | 30 | 1.926 | A | Present inv. |
| B8 | Cu | 0.00100 | Hydrochloric acid | 3 | 70 | 30 | 1.925 | A | Present inv. |
| B9 | Cu | 0.00100 | Hydrochloric acid | 5 | 70 | 30 | 1.923 | A | Present inv. |
| B10 | Cu | 0.00100 | Hydrochloric acid | 6 | 70 | 30 | 1.923 | A | Present inv. |
| B11 | Cu | 0.00100 | Hydrochloric acid | 7 | 10 | 30 | 1.913 | B | Present inv. |
| B12 | Cu | 0.00100 | Hydrochloric acid | 3 | 10 | 30 | 1.913 | B | Present inv. |
| B13 | Cu | 0.00100 | Hydrochloric acid | 3 | 15 | 30 | 1.921 | A | Present inv. |
| B14 | Cu | 0.00100 | Hydrochloric acid | 3 | 50 | 30 | 1.923 | A | Present inv. |
| B15 | Cu | 0.00100 | Hydrochloric acid | 3 | 100 | 30 | 1.925 | A | Present inv. |
| B16 | Cu | 0.00100 | Hydrochloric acid | 3 | 70 | 3 | 1.911 | B | Present inv. |
| B17 | Cu | 0.00100 | Hydrochloric acid | 3 | 70 | 5 | 1.921 | A | Present inv. |
| B18 | Cu | 0.00100 | Hydrochloric acid | 3 | 70 | 10 | 1.922 | A | Present inv. |
| B19 | Cu | 0.00100 | Hydrochloric acid | 3 | 70 | 100 | 1.926 | A | Present inv. |
| B20 | Cu | 0.00100 | Hydrochloric acid | 3 | 70 | 200 | 1.926 | A | Present inv. |
| B21 | Hg | 0.00100 | Hydrochloric acid | 3 | 70 | 30 | 1.925 | A | Present inv. |
| B22 | Ag | 0.00100 | Hydrochloric acid | 3 | 70 | 30 | 1.926 | A | Present inv. |
| B23 | Pb | 0.00100 | Hydrochloric acid | 3 | 70 | 30 | 1.925 | A | Present inv. |
| B24 | Cd | 0.00100 | Hydrochloric acid | 3 | 70 | 30 | 1.925 | A | Present inv. |
| B25 | Co | 0.00100 | Hydrochloric acid | 3 | 70 | 30 | 1.925 | A | Present inv. |
| B26 | Zn | 0.00100 | Hydrochloric acid | 3 | 70 | 30 | 1.925 | A | Present inv. |
| B27 | Ni | 0.00100 | Hydrochloric acid | 3 | 70 | 30 | 1.925 | A | Present inv. |
| B28 | Cu + Ni | 0.00100 | Hydrochloric acid | 3 | 70 | 30 | 1.925 | A | Present inv. |
| B29 | Ag + Co + Zn | 0.00100 | Hydrochloric acid | 3 | 70 | 30 | 1.926 | A | Present inv. |
| B30 | Cu | 0.10000 | Sulfuric acid | 2.5 | 70 | 30 | 1.925 | A | Present inv. |
| B31 | Cu | 0.10000 | Nitric acid | 2.5 | 70 | 30 | 1.925 | A | Present inv. |
| B32 | Cu | 0.10000 | Phosphoric acid | 2.5 | 70 | 30 | 1.923 | A | Present inv. |

Referring to the results of Table 2, it was learned that grain-oriented electrical steel sheets satisfying the conditions of the present embodiment were judged to be good.

Example 3

First, a steel ingot containing C: 0.09%, Si: 3.3%, Mn: 0.09%, S: 0.023%, acid soluble Al: 0.03%, N: 0.009%, and P: 0.004% and having a balance of the constituents shown in Table 3 and Fe and impurities was prepared. The steel ingot was annealed at 1350° C. for 1 hour, then was hot rolled to thereby obtain thickness 2.3 mm hot rolled steel sheets. The obtained hot rolled sheet sheets were annealed at a peak temperature of 1100° C. for 140 seconds and treated by solution contact (serving also as pickling), then cold rolled to thereby obtain thickness 0.23 mm cold rolled steel sheets. Here, the conditions of the solution contact treatment (pickling condition) after hot rolled annealing were a concentration of Cu in the solution: 0.001%, solution (base): hydrochloric acid, pH of solution: 3, solution temperature: 70° C., and contact time between solution and steel sheet: 30 seconds.

Next, the obtained cold rolled steel sheets were annealed for primary recrystallization in a wet hydrogen atmosphere and 850° C. for 180 seconds. Next, the surfaces of the steel sheets after primary recrystallization annealing were coated with an annealing separator containing MgO in the state of an aqueous slurry and then dried. After that, these were finish annealed and the finish annealed steel sheets were rinsed. After that, the surfaces of the steel sheets were coated with an insulation coating having aluminum phosphate and colloidal silica as its main constituents, then were annealed for flattening for the purpose of baking on the insulation coating and flattening the steel sheets.

Samples of grain-oriented electrical steel sheets obtained by the above were cut and annealed to remove strain, then the single sheet magnetic characteristic measurement method for a sample size of 60 mm×300 mm (based on the method described in JIS C2556) was used to measure the magnetic flux density B8 values of the grain-oriented electrical steel sheets according to the invention examples and comparative examples. Here, the B8 value is the magnetic flux density of a steel sheet when exciting a grain-oriented electrical steel sheet by 50 Hz at 800 A/m. In the present invention, the average value of five samples was used.

Here, a condition where the magnetic flux density B8 value of the grain-oriented electrical steel sheet became 1.93 T or more was judged as very good (S).

The production conditions, measurement results, and evaluations of the above present examples and comparative examples are shown in Table 3.

TABLE 3

| Condition | Constituents in slab | | | | | | Magnetic flux density | Evaluation | Remarks |
|---|---|---|---|---|---|---|---|---|---|
| | Cu content (%) | Sn content (%) | Ni content (%) | Cr content (%) | Sb content (%) | Bi content (%) | B8 value (T) | | |
| C1 | 0.0005 | 0 | 0 | 0 | 0 | 0 | 1.931 | S | Present inv. |
| C2 | 0.3000 | 0 | 0 | 0 | 0 | 0 | 1.933 | S | Present inv. |
| C3 | 1.0000 | 0 | 0 | 0 | 0 | 0 | 1.933 | S | Present inv. |
| C4 | 0 | 0.0005 | 0 | 0 | 0 | 0 | 1.931 | S | Present inv. |
| C5 | 0 | 0.3000 | 0 | 0 | 0 | 0 | 1.932 | S | Present inv. |
| C6 | 0 | 1.0000 | 0 | 0 | 0 | 0 | 1.933 | S | Present inv. |
| C7 | 0 | 0 | 0.0005 | 0 | 0 | 0 | 1.931 | S | Present inv. |
| C8 | 0 | 0 | 0.3000 | 0 | 0 | 0 | 1.933 | S | Present inv. |
| C9 | 0 | 0 | 1.0000 | 0 | 0 | 0 | 1.933 | S | Present inv. |
| C10 | 0 | 0 | 0 | 0.0005 | 0 | 0 | 1.931 | S | Present inv. |
| C11 | 0 | 0 | 0 | 0.3000 | 0 | 0 | 1.932 | S | Present inv. |
| C12 | 0 | 0 | 0 | 1.0000 | 0 | 0 | 1.932 | S | Present inv. |
| C13 | 0 | 0 | 0 | 0 | 0.0005 | 0 | 1.931 | S | Present inv. |
| C14 | 0 | 0 | 0 | 0 | 0.3000 | 0 | 1.933 | S | Present inv. |
| C15 | 0 | 0 | 0 | 0 | 1.0000 | 0 | 1.933 | S | Present inv. |
| C16 | 0 | 0 | 0 | 0 | 0 | 0.0005 | 1.935 | S | Present inv. |
| C17 | 0 | 0 | 0 | 0 | 0 | 0.3000 | 1.937 | S | Present inv. |
| C18 | 0 | 0 | 0 | 0 | 0 | 1.0000 | 1.937 | S | Present inv. |
| C19 | 0.1 | 0.1 | 0 | 0 | 0 | 0 | 1.932 | S | Present inv. |
| C20 | 0.1 | 0 | 0.1 | 0.1 | 0 | 0 | 1.932 | S | Present inv. |
| C21 | 0 | 0.1 | 0 | 0 | 0.1 | 0.1 | 1.937 | S | Present inv. |
| C22 | 0 | 0 | 0 | 0.1 | 0.1 | 0.1 | 1.937 | S | Present inv. |
| C23 | 0.1 | 0.1 | 0.1 | 0.1 | 0.1 | 0.1 | 1.937 | S | Present inv. |

Referring to the results of Table 3, it was learned that grain-oriented electrical steel sheets satisfying the conditions of the present embodiment were judged to be good.

Example 4

First, a steel ingot containing C: 0.09%, Si: 3.3%, Mn: 0.09%, S: 0.023%, acid soluble Al: 0.03%, N: 0.009%, and P: 0.004% and having a balance of Fe and impurities was prepared. The steel ingot was annealed at 1350° C. for 1 hour, then was hot rolled to thereby obtain thickness 2.3 mm hot rolled steel sheets. The obtained hot rolled sheet sheets were annealed at a peak temperature of 1100° C. for 140 seconds, pickled, then cold rolled to thereby obtain thickness 0.23 mm cold rolled steel sheets. Here, the pickling conditions after hot rolled annealing were a concentration of Cu in the pickling solution: 0.000005%, pickling solution: hydrochloric acid, pH of solution: 3, pickling solution temperature: 70° C., and contact time between pickling solution and steel sheet: 30 seconds.

Next, the obtained cold rolled steel sheets were annealed for primary recrystallization in a wet hydrogen atmosphere and 850° C. for 180 seconds. Next, the surfaces of the steel sheets after primary recrystallization annealing were coated with an annealing separator containing MgO in the state of an aqueous slurry and then dried. After that, these were finish annealed and the finish annealed steel sheets were brought into contact with a solution (serving also as pickling). After that, the surfaces of the steel sheets were coated with an insulation coating having aluminum phosphate and colloidal silica as its main constituents, then were annealed for flattening for the purpose of baking on the insulation coating and flattening the steel sheets. Here, the solution contact conditions (pickling conditions) after finish annealing were the conditions shown in Table 4.

Furthermore, the above samples were cut to 30 mm widths and subjected to a bend test using cylinders of various sizes. Here, the smallest cylinder size (diameter) at which the insulation coating did not peel off was made the peeling size (mm). The test method was performed as follows: Test pieces of the test nos. were subjected to bend tests by a curvature of 8 to 30 mm. A bend test was performed using a cylindrical mandrel bend tester, placing the tester on the test piece so that the axial direction of the cylinder matched the width direction of the test piece, and bending the test piece up to 180° C. Adhesive tape was attached to the surface of the bend test piece, bend tests were conducted under various curvatures, then the adhesive tape was peeled off and deposition of insulation coating at the bent part of the adhesive tape was checked for to confirm the peeling size.

Here, a condition where the peeling diameter was 20 mm or less was judged as good (B). Further, a condition where the peeling diameter was 10 mm or less was judged as the best (A). Further, conditions other than the above were judged as poor (C).

The production conditions, measurement results, and evaluations of the above present examples and comparative examples are shown in Table 4.

TABLE 4

| Condition | Solution treatment condition: Metal type | Metal type concentration (%) | Solution (Base) | pH | Solution temperature (° C.) | Contact time of solution and steel sheet (s) | Peeling size (mm) | Evaluation | Remarks |
|---|---|---|---|---|---|---|---|---|---|
| D1 | Cu | 0.000005 | Hydrochloric acid | 3 | 70 | 30 | 25 | C | Comp. inv. |
| D2 | Cu | 0.000010 | Hydrochloric acid | 3 | 70 | 30 | 20 | B | Present inv. |
| D3 | Cu | 0.00010 | Hydrochloric acid | 3 | 70 | 30 | 10 | A | Present inv. |
| D4 | Cu | 0.01000 | Hydrochloric acid | 3 | 70 | 30 | 10 | A | Present inv. |
| D5 | Cu | 0.10000 | Hydrochloric acid | 3 | 70 | 30 | 8 | A | Present inv. |
| D6 | Cu | 1.00000 | Hydrochloric acid | 3 | 70 | 30 | 8 | A | Present inv. |
| D7 | Cu | 0.00100 | Hydrochloric acid | 0 | 70 | 30 | 8 | A | Present inv. |
| D8 | Cu | 0.00100 | Hydrochloric acid | 3 | 70 | 30 | 10 | A | Present inv. |
| D9 | Cu | 0.00100 | Hydrochloric acid | 5 | 70 | 30 | 10 | A | Present inv. |
| D10 | Cu | 0.00100 | Hydrochloric acid | 6 | 70 | 30 | 20 | B | Present inv. |
| D11 | Cu | 0.00100 | Hydrochloric acid | 7 | 70 | 30 | 20 | B | Present inv. |
| D12 | Cu | 0.00100 | Hydrochloric acid | 3 | 10 | 30 | 16 | B | Present inv. |
| D13 | Cu | 0.00100 | Hydrochloric acid | 3 | 15 | 30 | 10 | A | Present inv. |
| D14 | Cu | 0.00100 | Hydrochloric acid | 3 | 50 | 30 | 10 | A | Present inv. |
| D15 | Cu | 0.00100 | Hydrochloric acid | 3 | 100 | 30 | 8 | A | Present inv. |
| D16 | Cu | 0.00100 | Hydrochloric acid | 3 | 70 | 3 | 20 | B | Present inv. |
| D17 | Cu | 0.00100 | Hydrochloric acid | 3 | 70 | 5 | 10 | A | Present inv. |
| D18 | Cu | 0.00100 | Hydrochloric acid | 3 | 70 | 10 | 10 | A | Present inv. |
| D19 | Cu | 0.00100 | Hydrochloric acid | 3 | 70 | 100 | 8 | A | Present inv. |
| D20 | Cu | 0.00100 | Hydrochloric acid | 3 | 70 | 200 | 8 | A | Present inv. |
| D21 | Hg | 0.00100 | Hydrochloric acid | 3 | 70 | 30 | 10 | A | Present inv. |
| D22 | Ag | 0.00100 | Hydrochloric acid | 3 | 70 | 30 | 10 | A | Present inv. |
| D23 | Pb | 0.00100 | Hydrochloric acid | 3 | 70 | 30 | 10 | A | Present inv. |
| D24 | Cd | 0.00100 | Hydrochloric acid | 3 | 70 | 30 | 10 | A | Present inv. |
| D25 | Co | 0.00100 | Hydrochloric acid | 3 | 70 | 30 | 10 | A | Present inv. |
| D26 | Zn | 0.00100 | Hydrochloric acid | 3 | 70 | 30 | 10 | A | Present inv. |
| D27 | Ni | 0.00100 | Hydrochloric acid | 3 | 70 | 30 | 10 | A | Present inv. |
| D28 | Cu + Ni | 0.00100 | Hydrochloric acid | 3 | 70 | 30 | 10 | A | Present inv. |
| D29 | Ag + Co + Zn | 0.00100 | Hydrochloric acid | 3 | 70 | 30 | 10 | A | Present inv. |
| D30 | Cu | 0.10000 | Sulfuric acid | 2.5 | 70 | 30 | 10 | A | Present inv. |
| D31 | Cu | 0.10000 | Nitric acid | 2.5 | 70 | 30 | 10 | A | Present inv. |
| D32 | Cu | 0.10000 | Phosphoric acid | 2.5 | 70 | 30 | 10 | A | Present inv. |

Referring to the results of Table 4, it was learned that grain-oriented electrical steel sheets satisfying the conditions of the present embodiment were judged to be good. Note that, the samples were measured for the magnetic flux density B8 value by a technique similar to Examples 1 to 3, whereupon in each case, a good result of 1.90 T or more was obtained.

Example 5

A steel ingot containing C: 0.0016%, Si: 2.74%, Mn: 0.22%, S: 0.0008%, acid soluble Al: 0.87%, N: 0.0014%, P: 0.02%, and Sn: 0.06% and having a balance of Fe and impurities was prepared. The steel ingot was annealed at 1080° C. for 1 hour, then was hot rolled to thereby obtain thickness 1.8 mm hot rolled steel sheets. The obtained hot rolled sheet sheets were annealed at a peak temperature of 1050° C. for 120 seconds, treated by solution contact (also serving as pickling), then cold rolled to thereby obtain thickness 0.25 mm cold rolled steel sheets. Here, the solution contact conditions (pickling conditions) after hot rolled annealing were as shown by the conditions in Table 5. Next, the obtained cold rolled steel sheets were annealed for primary recrystallization at 950° C. for 30 seconds, then coated with an insulation coating.

From samples of the above obtained non-oriented electrical steel sheets, ring-shaped cores with outside diameters of 125 mm and inside diameters of 100 mm were stamped and stacked to 20 mm thicknesses (80 sheets), then were excited by 50 Hz to 1.5 T and measured for the rises in core temperatures. Here, a condition with a rise in core temperature of 20° C. or less was judged as good (A). Further, conditions other than the above (more than 20° C.) were judged as poor (C).

The solution contact conditions (pickling conditions) and evaluations of the above present invention examples and comparative examples are shown in Table 5.

TABLE 5

| Condition | Solution treatment condition: Metal type | Metal type concentration (%) | Solution (Base) | pH | Solution temperature (° C.) | Contact time of solution and steel sheet (s) | Evaluation | Remarks |
|---|---|---|---|---|---|---|---|---|
| N1 | Cu | 0.000005 | Hydrochloric acid | 3 | 70 | 30 | C | Comp. inv. |
| N2 | Cu | 0.000010 | Hydrochloric acid | 3 | 70 | 30 | A | Present inv. |
| N3 | Cu | 0.00010 | Hydrochloric acid | 3 | 70 | 30 | A | Present inv. |
| N4 | Cu | 0.01000 | Hydrochloric acid | 3 | 70 | 30 | A | Present inv. |

TABLE 5-continued

| | Solution treatment condition | | | | | | | |
|---|---|---|---|---|---|---|---|---|
| Condition | Metal type | Metal type concentration (%) | Solution (Base) | pH | Solution temperature (° C.) | Contact time of solution and steel sheet (s) | Evaluation | Remarks |
| N5 | Cu | 0.10000 | Hydrochloric acid | 3 | 70 | 30 | A | Present inv. |
| N6 | Cu | 1.00000 | Hydrochloric acid | 3 | 70 | 30 | A | Present inv. |
| N7 | Cu | 0.00100 | Hydrochloric acid | 0 | 70 | 30 | A | Present inv. |
| N8 | Cu | 0.00100 | Hydrochloric acid | 3 | 70 | 30 | A | Present inv. |
| N9 | Cu | 0.00100 | Hydrochloric acid | 5 | 70 | 30 | A | Present inv. |
| N10 | Cu | 0.00100 | Hydrochloric acid | 3 | 15 | 30 | A | Present inv. |
| N11 | Cu | 0.00100 | Hydrochloric acid | 3 | 50 | 30 | A | Present inv. |

Referring to the results of Table 5, it was learned that non-oriented electrical steel sheets satisfying the conditions of the present embodiment were improved in thermal conductivity, so were excellent in heat removal, therefore the rise in temperature of a stacked core was suppressed and the results are judged good.

The invention claimed is:

1. A method for producing an electrical steel sheet comprising:

a pickling process of bringing the electrical steel sheet containing, by mass %, C: more than 0% and 0.10% or less, Si: 2.5% or more and 4.5% or less, Mn: 0.01% or more and 5.0% or less, a total of one or more of S, Se, and Te: more than 0% and 0.050% or less, acid soluble Al: more than 0% and 5.0% or less, N: more than 0% and 0.015% or less, and P: more than 0% and 1.0% or less and having a balance of Fe and impurities, wherein the electrical steel sheet optionally contains, in place of part of the Fe, one or more of Cu: 1.0% or less, Sn: 1.0% or less, Ni: 1.0% or less, Cr: 1.0% or less, Sb: 1.0% or less, and Bi: 1.0% or less, into contact with a liquid solution, the solution containing, by mass %, one or more of Cu, Hg, Ag, Pb, Cd, Co, Zn, and Ni, in a total concentration of 0.00001% or more and 1.0000% or less, a pH of the solution is −1.5 or more and less than 7, a solution temperature is 15° C. or more and 100° C. or less, and a time during which the electrical steel sheet contacts the solution is 5 seconds or more and 200 seconds or less, the electrical steel sheet contains MnS, MnSe, and MnTe before contact with the solution, and upon or after contact with the solution, Mn of one or more of the MnS, MnSe, and MnTe at surface layers of the electrical steel sheet is substituted by one or more of the Cu, Hg, Ag, Pb, Cd, Co, Zn, and Ni.

2. The method for producing an electrical steel sheet according to claim 1, wherein the pickling process for bringing the electrical steel sheet into contact with the solution is performed at or after a hot rolling process and before a finish annealing process.

3. The method for producing an electrical steel sheet according to claim 1, wherein the pickling process for bringing the electrical steel sheet into contact with the solution is performed at or after a finish annealing process and before an insulation coating process.

* * * * *